US007934335B2

(12) United States Patent
Halverson

(10) Patent No.: US 7,934,335 B2
(45) Date of Patent: May 3, 2011

(54) POP-UP ADJUSTMENT CAP SYSTEM FOR SIGHTING DEVICE

(75) Inventor: Erik R. Halverson, Salem, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 374 days.

(21) Appl. No.: 11/868,619

(22) Filed: Oct. 8, 2007

(65) Prior Publication Data

US 2008/0236018 A1 Oct. 2, 2008

Related U.S. Application Data

(60) Provisional application No. 60/853,106, filed on Oct. 20, 2006.

(51) Int. Cl.
*F41G 1/387* (2006.01)

(52) U.S. Cl. ..... 42/137

(58) Field of Classification Search ..... 42/115, 42/139, 136, 137, 138; 33/298, 334; 359/428; 70/159

See application file for complete search history.

(56) References Cited

U.S. PATENT DOCUMENTS

| | | | | |
|---|---|---|---|---|
| 1,344,973 | A | | 6/1920 | Bader |
| 2,143,167 | A | | 1/1939 | Pechar |
| 2,165,796 | A | | 7/1939 | Humeston |
| 2,208,913 | A | | 7/1940 | Unertl |
| 2,229,637 | A | | 1/1941 | Burton |
| 2,336,107 | A | | 12/1943 | Litschert |
| 2,452,592 | A | * | 11/1948 | Meyer ..... 33/298 |
| 2,583,042 | A | | 1/1952 | Dayton |
| 2,585,933 | A | | 2/1952 | Harvey |
| 2,682,707 | A | * | 7/1954 | Dahlberg ..... 42/137 |
| 2,913,826 | A | | 11/1959 | Petty |
| 3,037,287 | A | | 6/1962 | Glatz et al. |
| 3,058,391 | A | | 10/1962 | Leupold |
| 3,222,987 | A | | 12/1965 | Wrigglesworth |
| 3,280,463 | A | | 10/1966 | Stadler |
| 3,297,389 | A | | 1/1967 | Gibson |
| 3,662,618 | A | | 5/1972 | Kroll et al. |
| 3,707,204 | A | | 12/1972 | Dussardier |
| 3,826,012 | A | | 7/1974 | Pachmayr |
| 3,916,721 | A | | 11/1975 | Egger |
| 3,990,155 | A | | 11/1976 | Akin, Jr. et al. |

(Continued)

FOREIGN PATENT DOCUMENTS

CN 2752794 1/2006

(Continued)

OTHER PUBLICATIONS

Article: *Bayonet Mount*, Answers.com Encyclodictionalmanacapedia, http://www.answers.com/topic/bayonet-mount, visited Sep. 28, 2006.

(Continued)

*Primary Examiner* — Stephen M Johnson
(74) *Attorney, Agent, or Firm* — Stoel Rives LLP

(57) ABSTRACT

Adjustment mechanisms that may be employed for making operational adjustments to sighting mechanisms such as riflescopes, telescopes, binoculars, monoculars or other types of viewing devices. One configuration being directed to a pop-up cap that is retained and remains connected to the adjustment mechanism, the pop-up cap translating between a first position (typically the closed position) where rotation of the cap does not engage the adjustment mechanism to a second (typically the extended position) where rotation of the cap engages the adjustment mechanism.

13 Claims, 13 Drawing Sheets

U.S. PATENT DOCUMENTS

| | | | |
|---|---|---|---|
| 3,999,442 | A | 12/1976 | Decker et al. |
| 4,012,966 | A | 3/1977 | Lieberman et al. |
| 4,026,397 | A | 5/1977 | Raus |
| 4,038,757 | A | 8/1977 | Hicks et al. |
| 4,132,129 | A | 1/1979 | Pratt |
| 4,154,125 | A | 5/1979 | Frank |
| 4,200,355 | A | 4/1980 | Williams, Jr. |
| 4,201,096 | A | 5/1980 | Morrison et al. |
| 4,247,161 | A | 1/1981 | Unertl, Jr. |
| 4,347,758 | A | 9/1982 | Geil et al. |
| 4,373,269 | A | 2/1983 | Doliber et al. |
| 4,389,791 | A | 6/1983 | Ackerman |
| 4,408,842 | A | 10/1983 | Gibson |
| 4,461,330 | A | 7/1984 | Judkins |
| 4,643,542 | A | 2/1987 | Gibson |
| 4,779,305 | A | 10/1988 | Gorsek |
| 4,955,253 | A | 9/1990 | Sakai et al. |
| 4,982,502 | A | 1/1991 | Weyrauch |
| 5,020,389 | A | 6/1991 | Sigler |
| 5,083,477 | A | 1/1992 | Geil |
| 5,121,653 | A | 6/1992 | Sigler |
| 5,152,187 | A | 10/1992 | LaFemina |
| 5,329,829 | A | 7/1994 | Sell |
| 5,363,559 | A | 11/1994 | McCarty |
| 5,433,010 | A | 7/1995 | Bell |
| 5,499,456 | A | 3/1996 | Tomita |
| 5,513,440 | A | 5/1996 | Murg |
| 5,586,569 | A | 12/1996 | Hanning et al. |
| 5,615,487 | A | 4/1997 | Tomita |
| 5,618,374 | A | 4/1997 | Byerley |
| 5,695,125 | A | 12/1997 | Kumar |
| 5,715,607 | A | 2/1998 | Murg |
| 5,771,595 | A | 6/1998 | Bell |
| 5,892,617 | A | 4/1999 | Wallace |
| 5,906,141 | A | 5/1999 | Abdelmoula |
| 5,930,934 | A | 8/1999 | Fisher et al. |
| 6,005,711 | A | 12/1999 | Mai et al. |
| 6,279,259 | B1 | 8/2001 | Otteman |
| 6,351,907 | B1 | 3/2002 | Otteman |
| 6,442,854 | B1 | 9/2002 | Liu et al. |
| 6,508,144 | B1 | 1/2003 | Vendetti et al. |
| 6,519,890 | B1 | 2/2003 | Otteman |
| 6,588,125 | B2 | 7/2003 | Proctor, Sr. |
| 6,643,970 | B2 | 11/2003 | Huber |
| 6,691,447 | B1 | 2/2004 | Otteman |
| 6,721,095 | B2 | 4/2004 | Huber |
| 6,772,550 | B1 | 8/2004 | Leatherwood |
| 6,848,628 | B2 | 2/2005 | Walker |
| 6,860,442 | B2 | 3/2005 | Datcuk, Jr. |
| 7,117,624 | B2 * | 10/2006 | Kim ..... 42/85 |
| 7,330,310 | B2 | 2/2008 | Hengst et al. |
| 2006/0268433 | A1 | 11/2006 | Thomas |
| 2006/0278035 | A1 | 12/2006 | Casas |
| 2007/0240356 | A1 | 10/2007 | Klepp et al. |
| 2008/0066364 | A1 | 3/2008 | Klepp et al. |
| 2009/0205461 | A1 | 8/2009 | Windauer |

FOREIGN PATENT DOCUMENTS

| | | | |
|---|---|---|---|
| DE | 2 148 967 | | 4/1973 |
| DE | 297 20 737 | U1 | 3/1998 |
| DE | 299 03 989 | U1 | 6/1999 |
| DE | 203 01 749 | U1 | 4/2003 |
| DE | 102 22 528 | A1 | 12/2003 |
| DE | 202006003770 | U1 | 7/2006 |
| DE | 202006003770 | | 9/2008 |
| GB | 598306 | | 2/1948 |
| GB | 708438 | | 5/1954 |
| GB | 1102022 | | 2/1968 |
| GB | 1 214 584 | | 12/1970 |
| GB | 2213959 | | 8/1989 |
| JP | 11085290 | A | 3/1999 |
| WO | WO 2006/060490 | A2 | 6/2006 |
| WO | WO 2006/109587 | A1 | 10/2006 |

OTHER PUBLICATIONS

Jun. 7, 2010 Office Action from corresponding Chinese Application No. 200710166859.X.

International Search Report and Written Opinion, International Appl. No. PCT/US05/43336 Jul. 8, 2008 (in the WO2006/060490).

* cited by examiner

POP-UP ADJUSTMENT CAP SYSTEM FOR SIGHTING DEVICE

RELATED APPLICATION DATA

This application claims priority to provisional application No. 60/853,106 filed Oct. 20, 2006 which is hereby incorporated by reference.

BACKGROUND

The field of the present invention generally relates to devices for actuating an adjustable feature on a sighting device such as a riflescope or spotting scope or other types of telescopic optical systems.

Telescopic sighting devices such as riflescopes, binoculars and telescopes may include an external adjustment mechanism or knob for actuating an inner working of the scope. For example, a riflescope is commonly used by hunters to aim their rifle at selected targets. Because bullet trajectory, wind conditions, and distance to the target can vary depending upon shooting conditions, quality riflescopes typically provide compensation for variations in these conditions by allowing a shooter to make small adjustments to the optical characteristics or the aiming of the riflescope relative to the firearm on which it is mounted. These adjustments are known as elevation and windage adjustments, and are typically accomplished by lateral movement of an adjusting member, such as a reticle located within the riflescope, as shown in U.S. Pat. No. 3,058,391 of Leupold, or pivotal movement of lenses mounted to a pivot tube within a housing of the riflescope to divert the optical path of the observed light before it reaches the reticle, as shown in U.S. Pat. Nos. 3,297,389 and 4,408,842 of Gibson. In these designs, a shooter accomplishes adjustment of windage and holdover by way of two laterally protruding adjustment knobs or adjustment screws, typically extended at right angles to each other, that are operatively connected to the adjusting member. A spring located between the housing and the adjusting member opposite the adjustment knobs biases the adjusting member against the adjustment knobs so that the adjusting member follows the movement of plunger screws of the adjustment knobs. Another external adjustment mechanism is focus. U.S. Pat. No. 6,351,907 discloses an external focus adjustment mechanism by which the position of an internal lens element is axially adjusted to change focus.

In these various external adjustment mechanisms, the adjustment knobs may be sealed to the housing to maintain a dry or inert gas charge within the interior of the housing to prevent fogging and condensation on internal lens surfaces.

It is desirable for these adjustment mechanisms or knobs to be readily accessible, and yet include some means to inhibit the adjustment from being inadvertently adjusted, such as bumping against the knob. One way of preventing such inadvertent adjustment is by providing a removable cap. The cap provides both physical protection from fouling or damage as well as physical isolation from inadvertent adjustment, but the cap must be removed in order to access the internal adjustment mechanism. Moreover, once the cap is removed, the user typically places it in a pocket or other location whereby the cap may be lost.

SUMMARY

The present invention relates to adjustment mechanisms that may be employed for making operational adjustments to sighting mechanisms such as riflescopes, telescopes, binoculars, monoculars or other types of viewing devices.

DETAILED DESCRIPTION OF PREFERRED EMBODIMENTS

Preferred embodiments will now be described with reference to the drawings. While the preferred embodiments will be described in terms of an adjustment assembly for a riflescope or spotting scope, the adjustment mechanism may also be employed with binoculars, monoculars and other types of optical viewing or sighting mechanisms.

Figure 1:
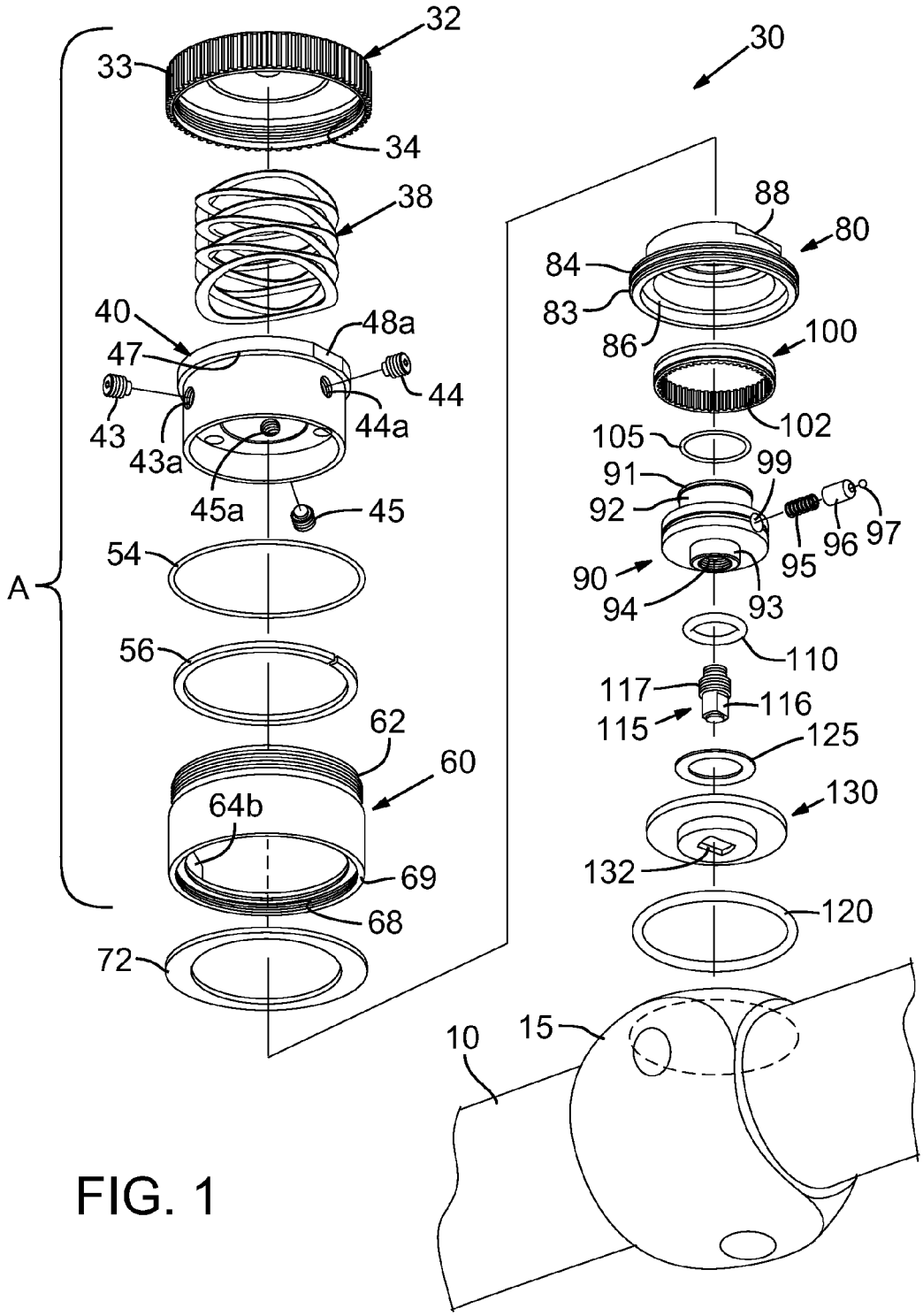
FIG. 1 is an exploded view of an adjustment mechanism according to a preferred embodiment.
Figure 2:
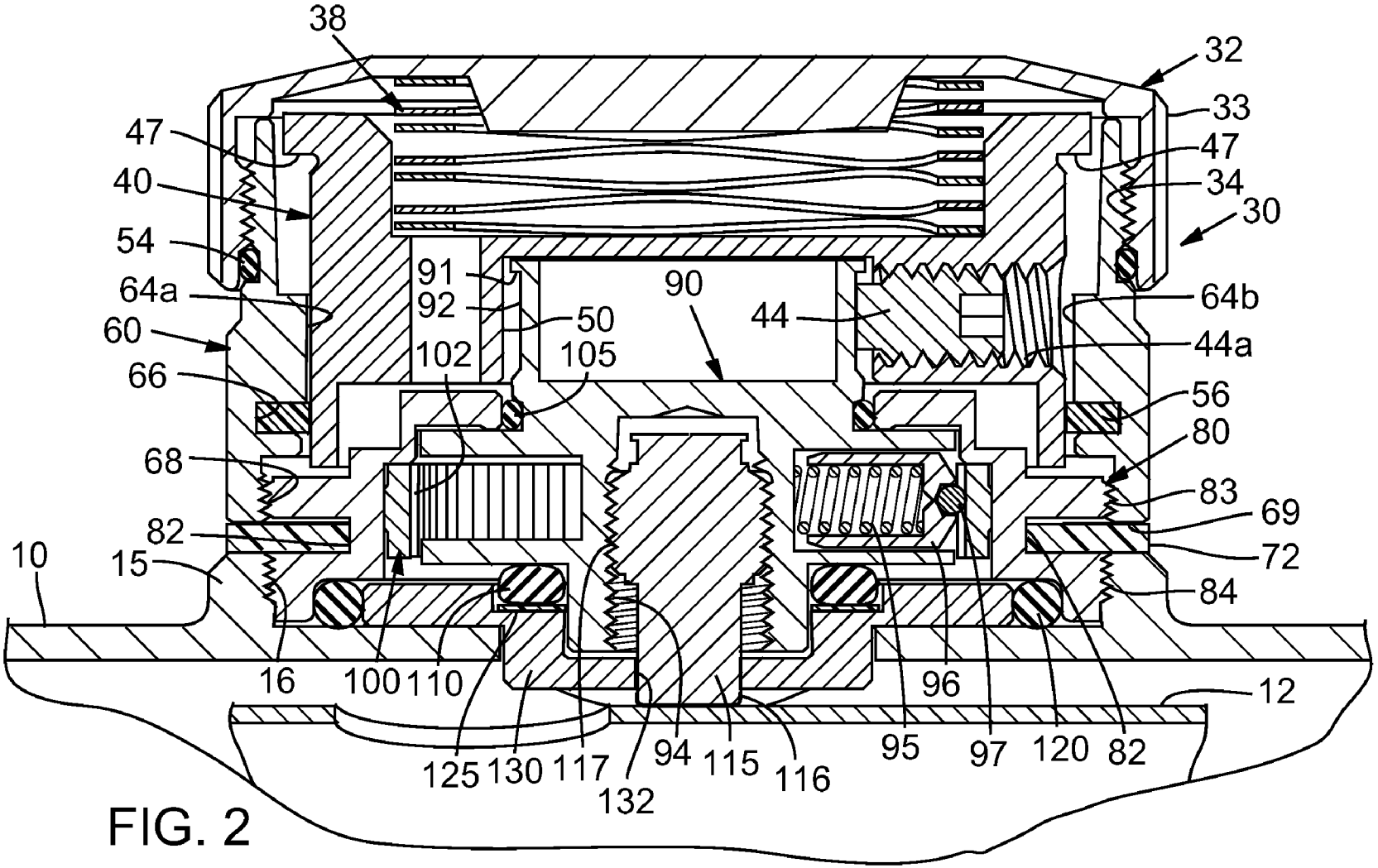
FIG. 2 is a cross-sectional view of the adjustment mechanism of FIG. 1 and shown assembled in position on a riflescope, and with the cap in a closed position.
Figure 3:
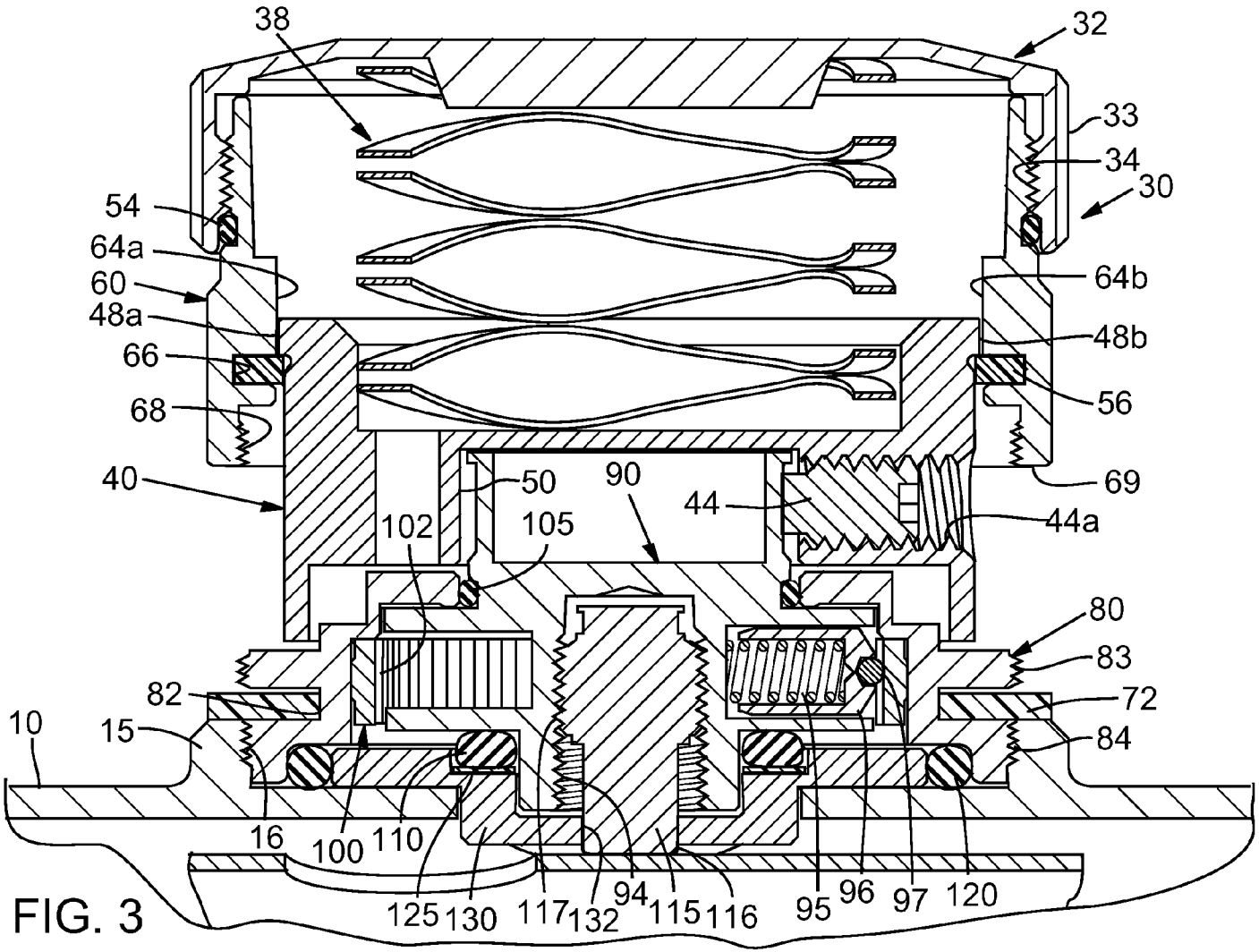
FIG. 3 is a cross-sectional view of the adjustment mechanism of FIGS. 1-2 with the cap in a released position and the adjustment screw in the retracted position.
Figure 4:
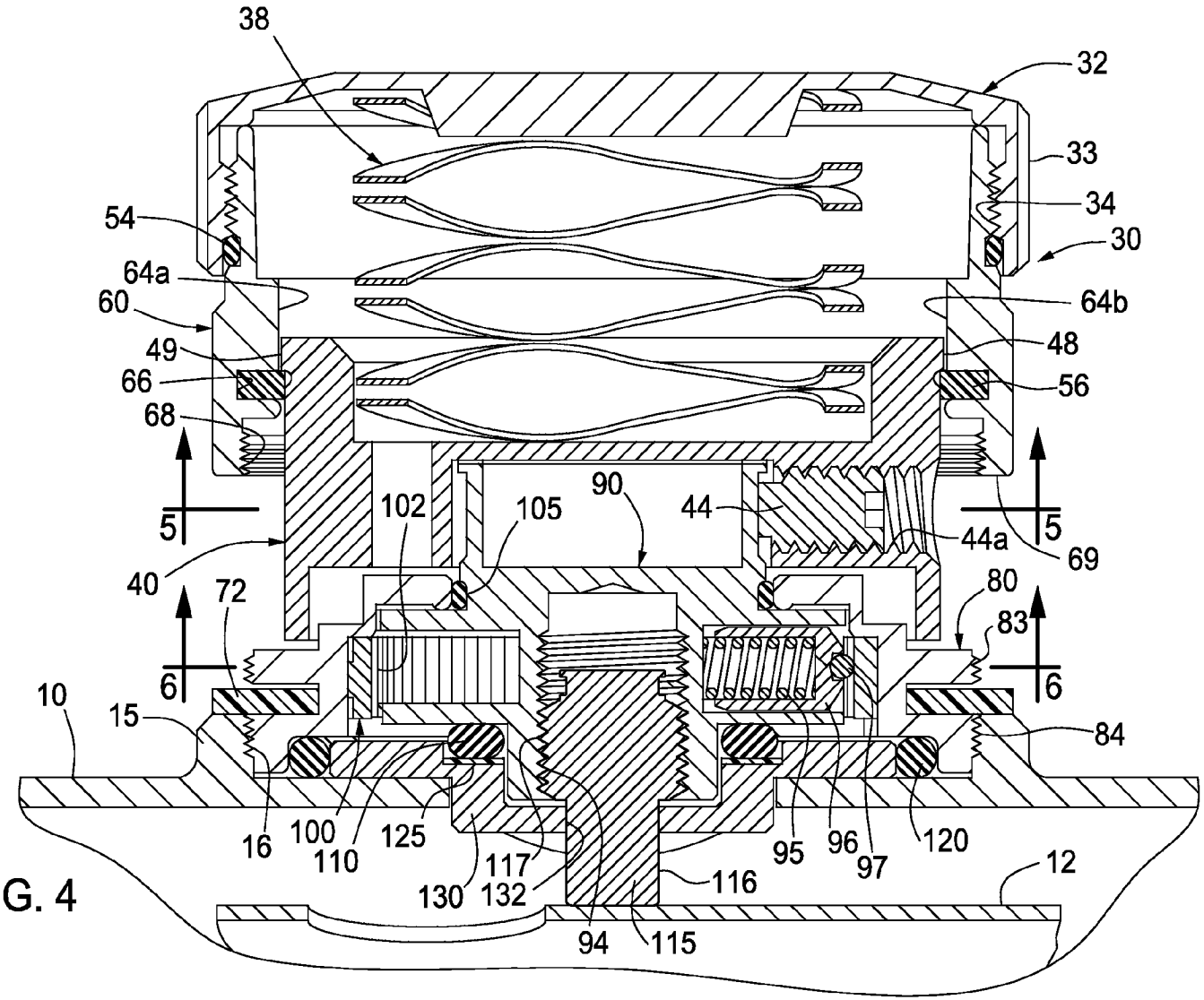
FIG. 4 is a cross-sectional view of the adjustment mechanism of FIGS. 1-3 with the cap in a released position and the adjustment screw in the extended position.
Figure 5:
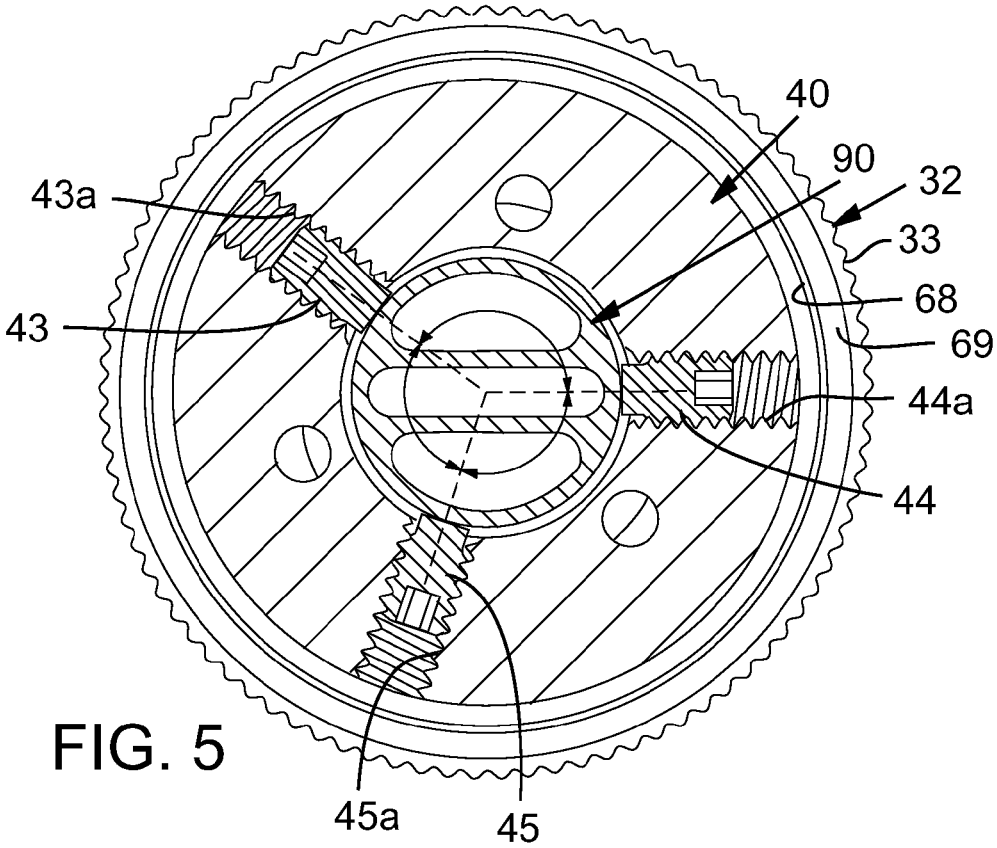
FIG. 5 is a cross-sectional view of FIG. 4 taken along line 5-5.
Figure 6:
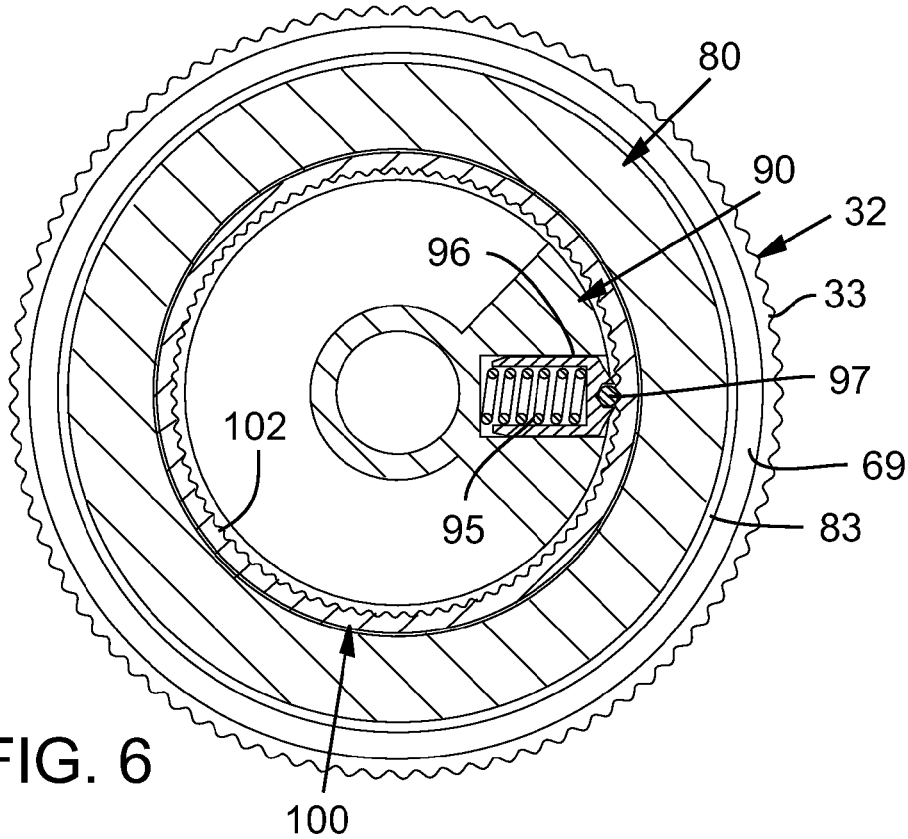
FIG. 6 is a cross-sectional view of FIG. 4 taken along line 6-6.

FIGS. 1-12 illustrate a first embodiment for an adjustment mechanism 30 as may be installed on a sighting mechanism. FIGS. 1 and 2 illustrate the device 30 being installed on a riflescope 10 at a turret section 15. FIG. 1 is an exploded view of the adjustment mechanism 30. FIG. 2 illustrates the mechanism in cross-section with the adjustment screw or plunger 115 in an upward position. By rotation of the upper section of the adjustment mechanism relative to the lower section, the adjustment screw 115 is translated from the upward position as shown in FIG. 2 to an inwardly extended position as shown in FIG. 4, thereby allowing adjustment of the pivoting element 12 within the riflescope 10.

Figure 11:
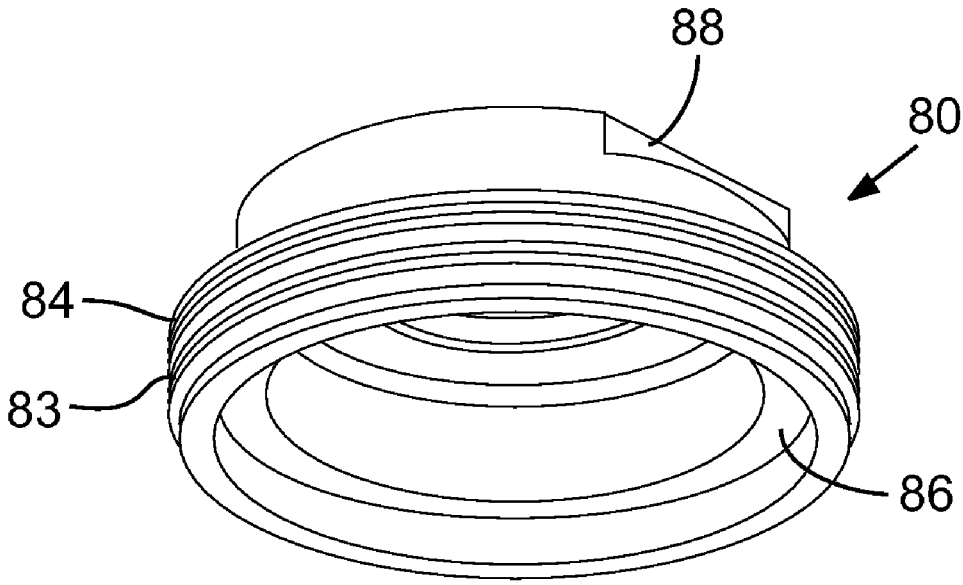
FIG. 11 is a detailed view of the adjustment flange element of FIG. 1.
Figure 12:
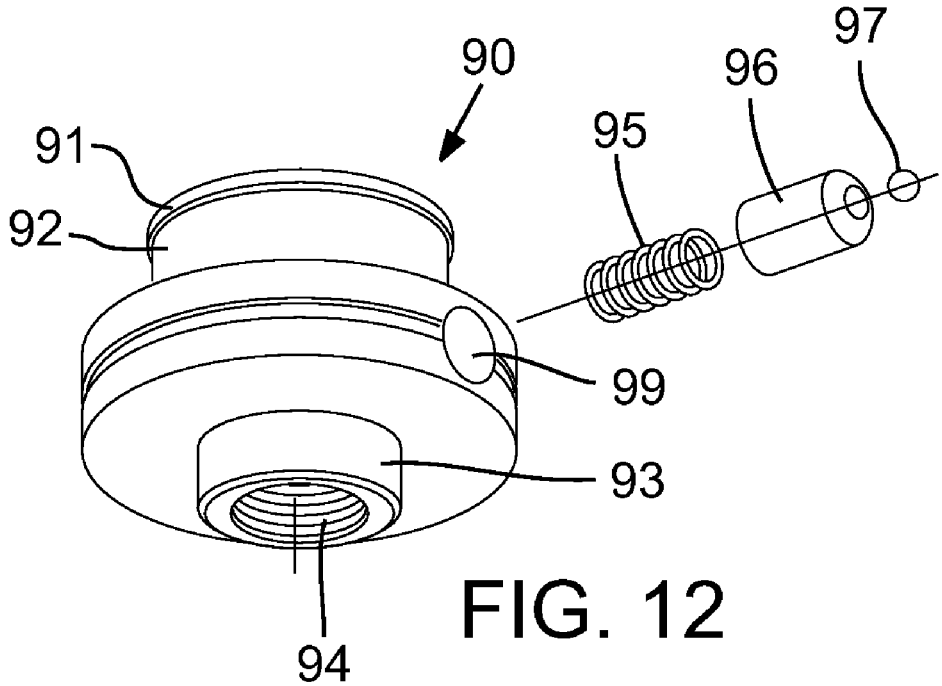
FIG. 12 is a detailed view of the adjustment nut element of FIG. 1.

Each of the components of the adjustment device 30 will now be described in detail. The lower section of the device 30 includes a holder piece 130 with a lower cylindrical extension that seats within the circular opening of the outer housing of the riflescope 10. The holder 130 is held in place by an adjustment flange 80. The adjustment flange 80 has lower male threads 83 (as shown in FIG. 11) that engage the female threads 16 of the riflescope turret section 15. An o-ring 120 is disposed in a cavity between the holder 130, the outer surface of the riflescope 10 and the ridge within the lower section of the adjustment flange 80 to provide a sealing surface therebetween. The holder 130 includes central opening 132, having a somewhat rectangular shape for slidably but non-rotatably receiving the lower rectangular section 116 of the adjustment screw 115. The threads 117 of the adjustment screw 115 engage the female threads within the adjustment nut 90 such that as the adjustment nut 90 is rotated, the adjustment screw 115 is prevented from rotating by the flat sides of the opening 132 in the holder 130, thereby axially translating the adjustment screw 115.

The adjustment nut 90 is seated against an o-ring 110, held in place by the adjustment flange 80. A Teflon gasket 125 is disposed on an upper surface of the holder 130 below the o-ring 110 to facilitate rotation of the adjustment nut 90 relative to the holder 130. A click-ring 100 is connected with an inner surface of the adjustment flange 80, disposed about the outer surface of the adjustment nut 90. A spring 95 and cup-shaped plunger 96 are disposed within a radial aperture 99 within the adjustment nut 90. The spring 95 urges the plunger 96 radially outward, the spring 95 comprising a means for biasing or urging the plunger 96 radially outward. A ball bearing 97 is disposed within a hole or channel within the plunger, and when installed, the ball bearing 97 is urged against the gear teeth 102 of the click-ring 100. Thus, when the adjustment nut 90 is rotated relative to the stationary click-ring 100 and adjustment flange 80, the user can feel and/or hear the ball 97 clicking past each gear tooth, each click then representing a desired rotational translation of the adjustment nut 90. Thus in response to rotation of the adjustment nut 90, the ball bearing 97 registers against the gear teeth 102 of the click-ring 100 with tactile clicks, each click indicating an incremental vertical adjustment (up or down) of the pivoting element 12 within the riflescope 10. Further details of a tactile feedback mechanism for a riflescope are disclosed in U.S. Pat. No. 6,519,890 hereby incorporated by reference. An o-ring 105 is disposed between the adjustment flange 80 and within a groove of the engagement surface 92 of the adjustment nut 90 as a seal between the two parts for preventing passage of dirt or other contaminants therebetween.

The adjustment flange 80 includes a pair of lateral notches or flats 88 on opposite sides for accommodating a wrench. During assembly a wrench is employed for engaging the flats 88 to rotate the adjustment flange 80 with the lower threads 83 engaging the inner threads 16 on the riflescope turret 15 and secure the flange 80 in place. The adjustment nut 90 includes an upwardly-extending cylindrical section 92 and a radially outward-extending shoulder 91.

The upper rotating section includes manually rotatable member such as an upper top cap 32, a wave spring 38, an index ring 40 secured by set screws 43, 44, 45 to the engagement surface 92 of the adjustment nut 90, an o-ring 54, a cap key 60, and a retainer ring 56 disposed within the cap key 60. The cap 32 serves the purpose of an actuator or knob to be grasped by the user and actuate the adjustment mechanism. The cap 32 has gripping notches 33 about its outer radial surface to facilitate grasping by the user during adjustment. The cap 32 may have an internal cavity or not depending upon the desired structure.

A gasket 72 is disposed within a groove 82 of the adjustment flange 80, the groove 82 being located between the upper threads 83 and the lower threads 84.

The top section, labeled as "A" in FIG. 1, is assembled by inserting the retainer ring 56 in the groove 66 located in an inner annular surface of cap key 60. The retainer ring 56 then forms an inwardly-extending shoulder having a diameter smaller than the diameter of the shoulder 47 of index ring 40. The outer diameter of the lower section of the index ring 40 is a smaller diameter that slides freely through the central portion within retainer ring 56. The cap key 60 includes flats 64*a*, 64*b* disposed on opposite internal surfaces. The flats 64*a*, 64*b* form inward shoulder sections on opposite sides of the cap key 60 of a smaller diameter than the flange shoulder 47 on the index ring 40. This flange shoulder 47 includes flats 48*a*, 48*b* on opposite sides thereof, corresponding to the flats 64*a*, 64*b* in the cap key 60. When the flats 48*a*, 48*b* are aligned with the flats 64*a*, 64*b*, the diameter of the flange shoulder 47 between the flats 48*a*, 48*b* is smaller than the diameter between the flats 64*a*, 64*b* and allows the flange shoulder 47 to pass by the flats 64*a*, 64*b* until the flange 47 shoulder contacts the retainer ring 56. In this position (contacting the retainer ring 56), the threaded holes 43*a*, 44*a*, 45*a* are below the lower sealing surface 69 of the cap key 60, and the index ring 40 is secured to the engagement surface 92 on the adjustment nut 90 via the set screws 43, 44, 45.

The wave spring 38 is positioned between the cap 32 and the index ring 40. The female internal threads 34 on the underside of the cap 32 threadily engage the male threads 62 on the cap key 60. When the cap 32 is in place, the spring 38 is flexed into a compression state. In that compression state, the spring 38 puts a biasing force upward on the cap 32 and cap key 60 relative to the index ring 40, the spring 38 comprising a means for biasing or urging the cap 32 upwardly. The o-ring 54 is disposed between the inside surface of the cap 32 and the outside surface of the cap key 60 below the threads 62 to provide a friction fit between these two elements. The cap 32 has gripping notches 33 about its outer radial surface to facilitate grasping by the user during adjustment. The o-ring 54 provides a desired friction fit for the cap 32, such that the cap 32 will not rotate relative to the cap key 60 during normal operation of the adjustment mechanism 30. Alternately, the cap 32 may be securely connected to the cap key 60 by some other mechanism, such as by gluing the threads. In such construction, the o-ring 54 could be eliminated.

The operation of the device will now be described with specific reference to FIGS. 2-4. FIG. 2 illustrates the adjustment mechanism 30 in the closed position with the spring 38 in the compressed position with the lower inner threads 68 of the cap key 60 engaged onto the threads 83 of the adjustment flange 80. The lower surface 69 of cap key 60 is engaged onto the washer 72 providing a seal against external elements.

In order to proceed to the adjustment state, the user grasps the top cap 32 and turns it in a counter-clockwise direction to disengage the cap key threads 68 from the flange threads 83. Once the threads are disengaged, the spring 38 will then urge the cap section (the cap 32 and cap key 60) upward (relative to the index ring 40) until the flange 47 shoulder contacts the flats 64*a*, 64*b*. The user then continues to rotate the cap 32 to position the flats 48*a*, 48*b* into alignment with the flats 64*a*, 64*b*. At that point, the spring 38 continues to urge the cap 32 and cap key 60 upward until the flange shoulder 47 comes into contact with the retainer ring 56.

The retainer ring 56 is made of a dissimilar material to the material of the index ring 40. The retainer ring 56 is preferably made of plastic or other suitable sound-dampening material(s) to allow for the desired sliding contact. An example where the index ring 40 and other elements are constructed of aluminum, the retainer ring may be constructed of plastic, brass or copper.

Once the cap 32 has translated into the upward extended position as shown in FIG. 3, the cap 32 and cap key 60 combination is rotationally secured to the index ring 40 for rotation therewith by engagement of the flats 48*a*, 48*b* to the flats 64*a*, 64*b*. As shown in FIG. 3, the adjustment screw 115 is in the upward position. By rotating the cap 32, the index ring 40 is rotated (being engaged to the cap key 60), thereby rotating the adjustment nut 90. By rotating the adjustment nut 90, the adjustment screw 115, being prevented from rotating itself due to the flats 116 engaging the corresponding flats 132 and the holder 130, axially translates from the contracted position shown in FIG. 3 to an extended position as shown in FIG. 4. Thus the adjustment screw 115 can be adjusted outwardly or inwardly to a desired position relative to the riflescope housing 10 via rotation of the cap section 32. Once the adjustment screw 115 is translated to the desired position, the user presses downwardly on the cap 32, disengaging the flats 64*a*, 64*b* from the flats 48*a*, 48*b* and then closes the cap combination 32/60 by screwing down the cap key threads 68 onto the threads 83 of the adjustment flange 80, returning the unit to the closed condition as in FIG. 1. This disengagement serves to provide protection from accidental/unintended movement of the adjustment mechanism.

Figure 7:
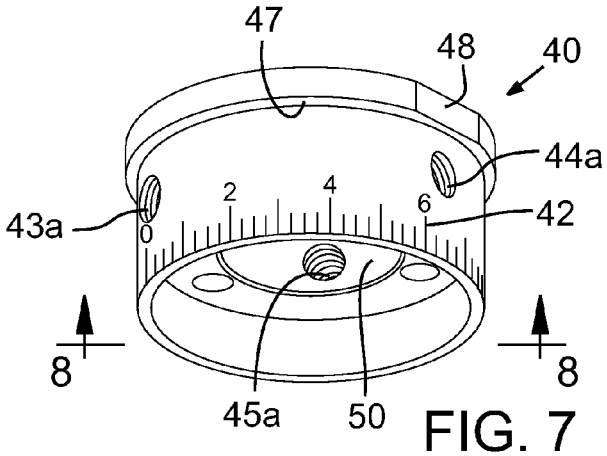
FIG. 7 is a detailed view of the index ring element of FIG. 1.
Figure 8:
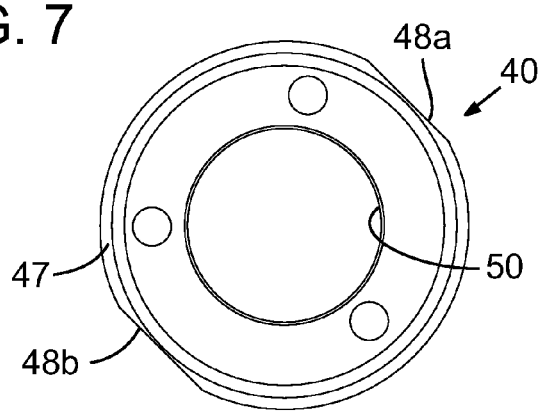
FIG. 8 is a plan view of FIG. 7 taken along line 8-8.
Figure 9:
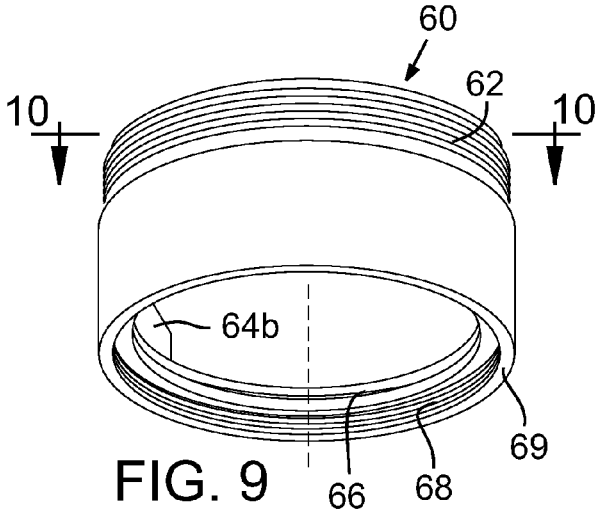
FIG. 9 is a detailed view of the cap element of FIG. 1.
Figure 10:
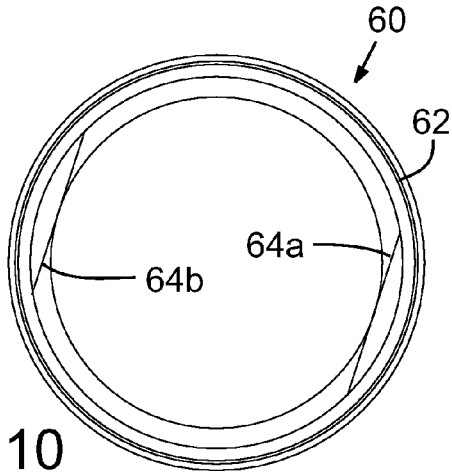
FIG. 10 is a cross-sectional view of FIG. 9 taken along line 10-10.

As shown in FIG. 7, the index ring 40 includes index markings 42 around its outer perimeter to assist the user in achieving the desired adjustment.

There are several mechanisms available for providing the spring or biasing mechanism between the index ring 40 and the cap combination 32/60 of this adjustment mechanism, that is, the spring or biasing mechanism comprises a means for biasing or urging the cap in a particular direction. The wave spring 38 provides a preferred spring configuration, but other types of springs, such as coil springs or leaf springs, may be employed. Another type of spring may comprise a compressible bladder disposed in the cavity between the top cap 32 and the index ring 40. Another spring mechanism may comprise using one or more magnets or combinations of the above. For example, a pair of disk magnets (oriented similarly to the magnets 238, 239 shown in FIG. 13) may be disposed between a top cap 232 and an index ring 240. In one configuration employing conventional magnets (where the magnetic poles are on the top and bottom sides of the disk), a top magnet 238 is attached by gluing to the underside of the cap 232 with the north pole of the magnet facing downward and a lower magnet 239 is attached to the index ring 240 with its north pole facing upward. In this arrangement the magnets 238, 239 would create an opposing force urging the index ring 240 and the top cap 232 apart functioning in similar fashion to the spring 38 of the first embodiment.

Figure 13:
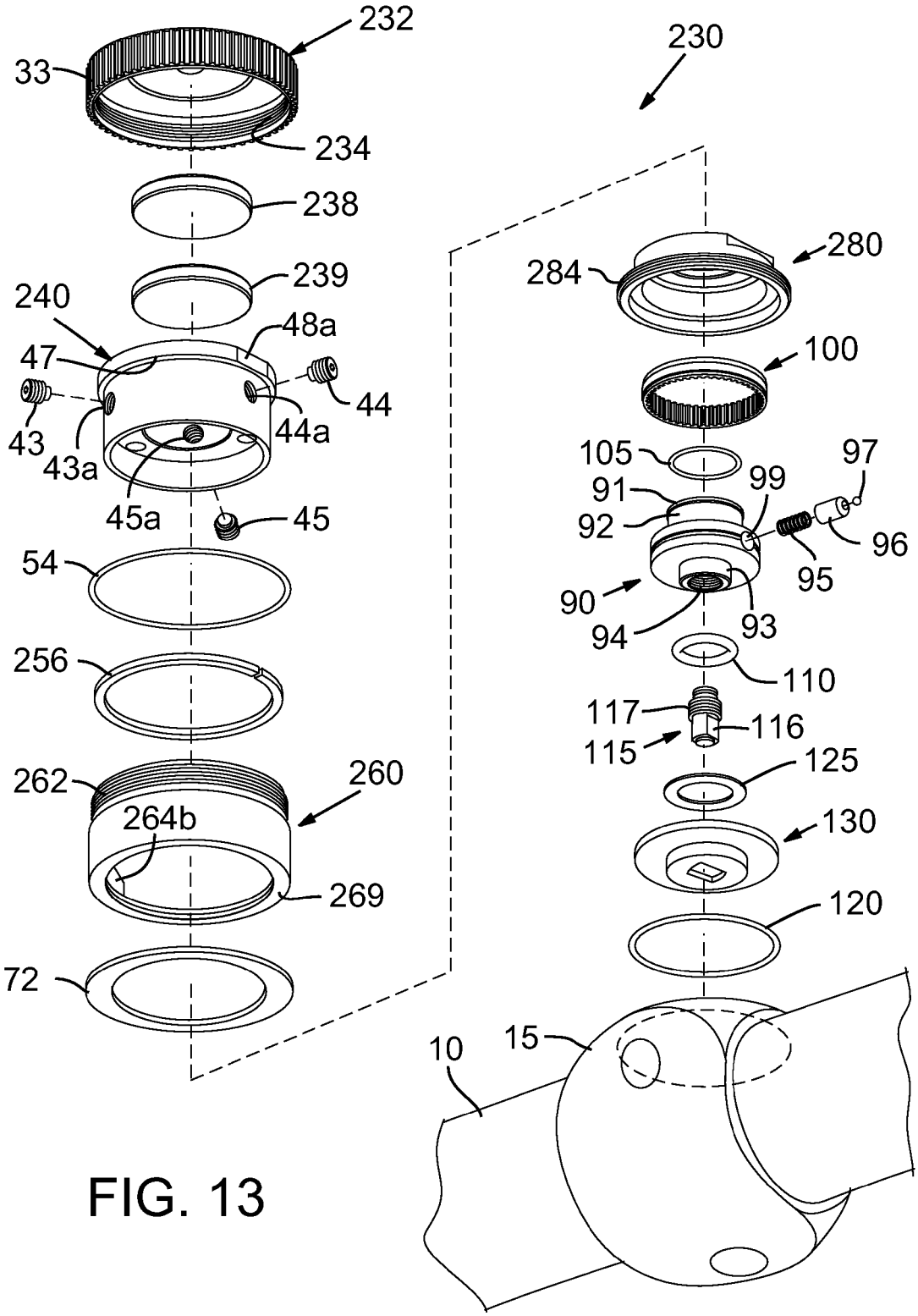
FIG. 13 is an exploded view of an adjustment mechanism according to another preferred embodiment.
Figure 14:
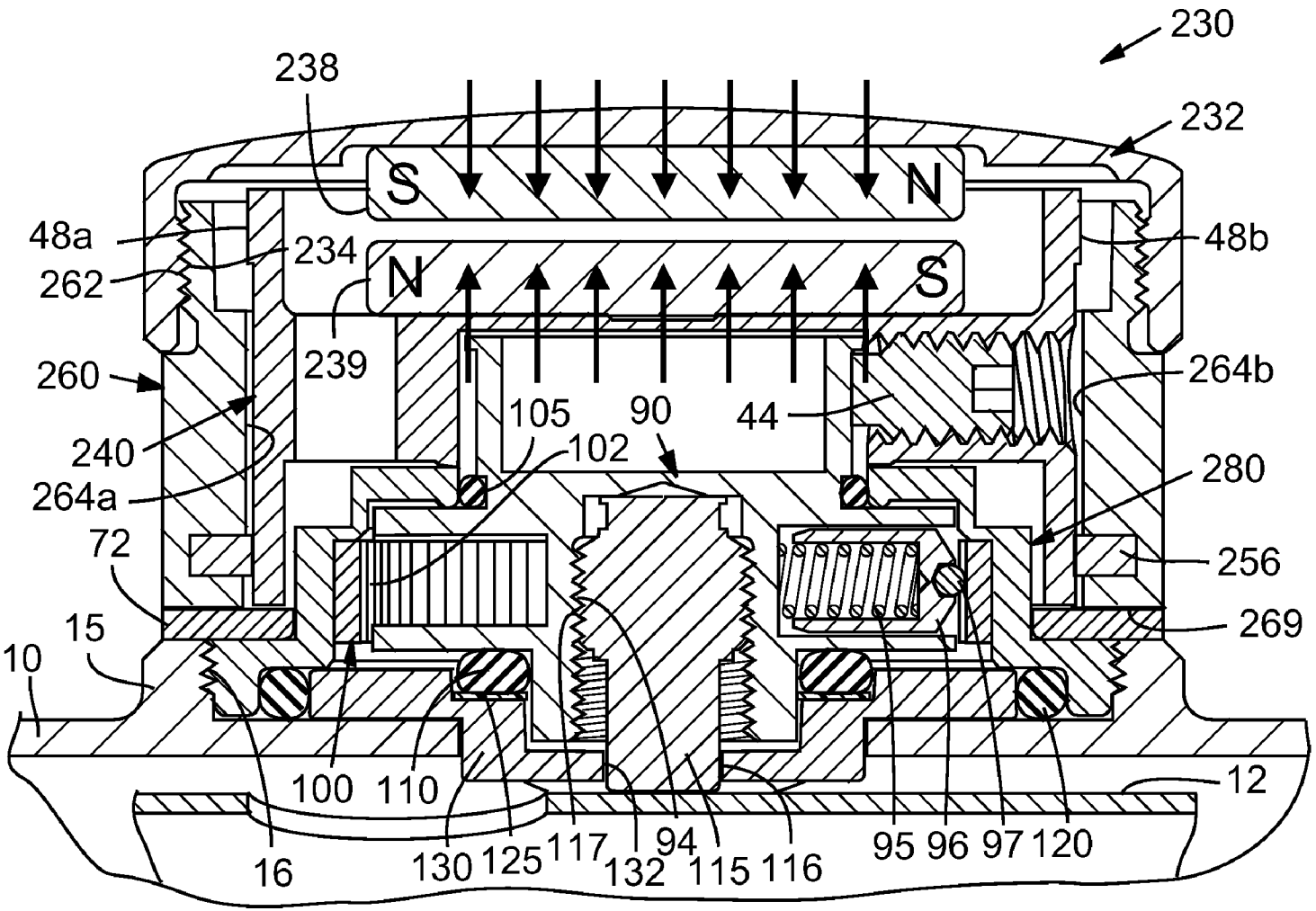
FIG. 14 is a cross-sectional view of the adjustment mechanism of FIG. 13 and shown assembled in position on a riflescope, and with the cap in a closed position.
Figure 15:
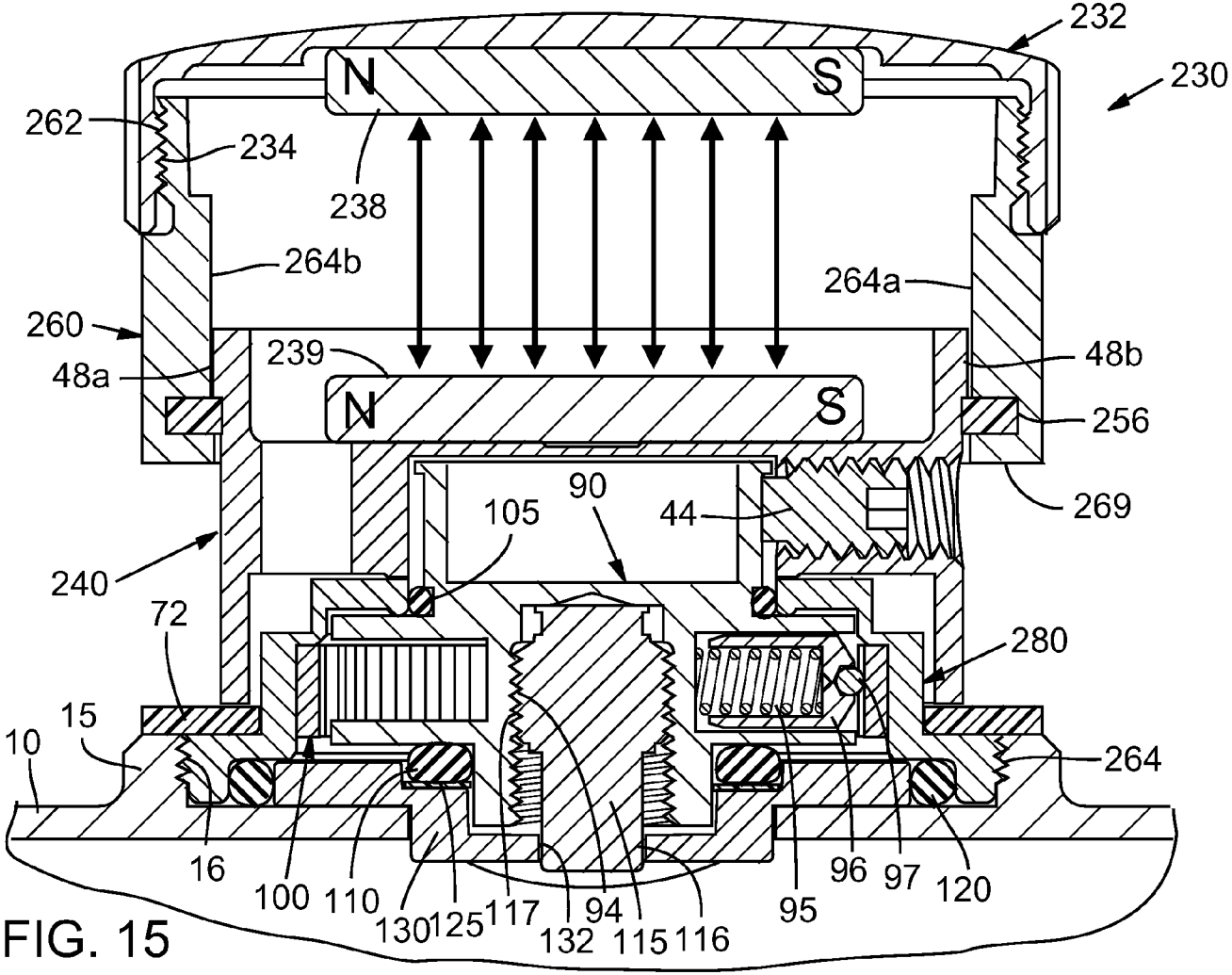
FIG. 15 is a cross-sectional view of the adjustment mechanism of FIGS. 13-14 with the cap in a released position and the adjustment screw in the retracted position.
Figure 16:
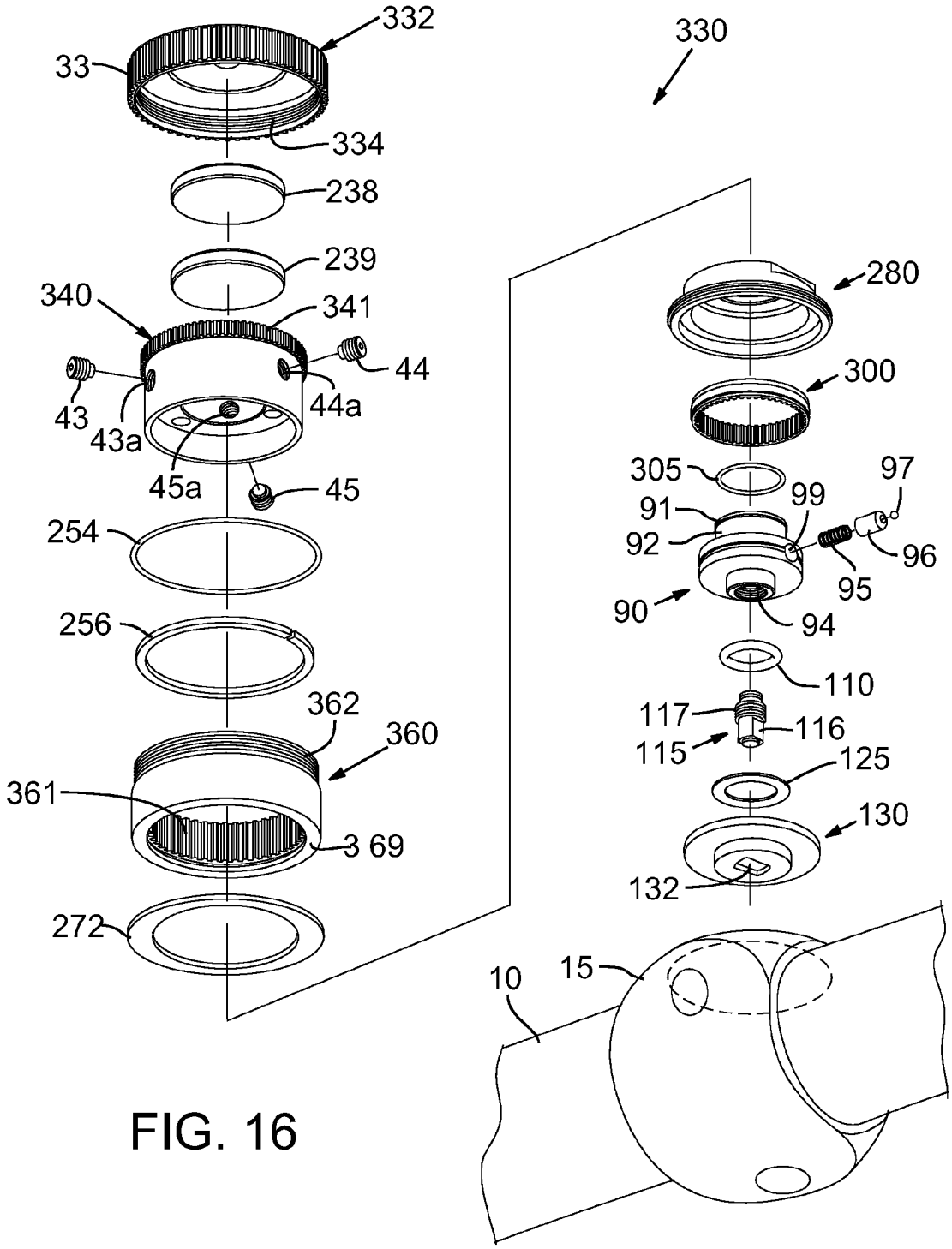
FIG. 16 is an exploded view of an adjustment mechanism according to another preferred embodiment.
Figures 17, 18:
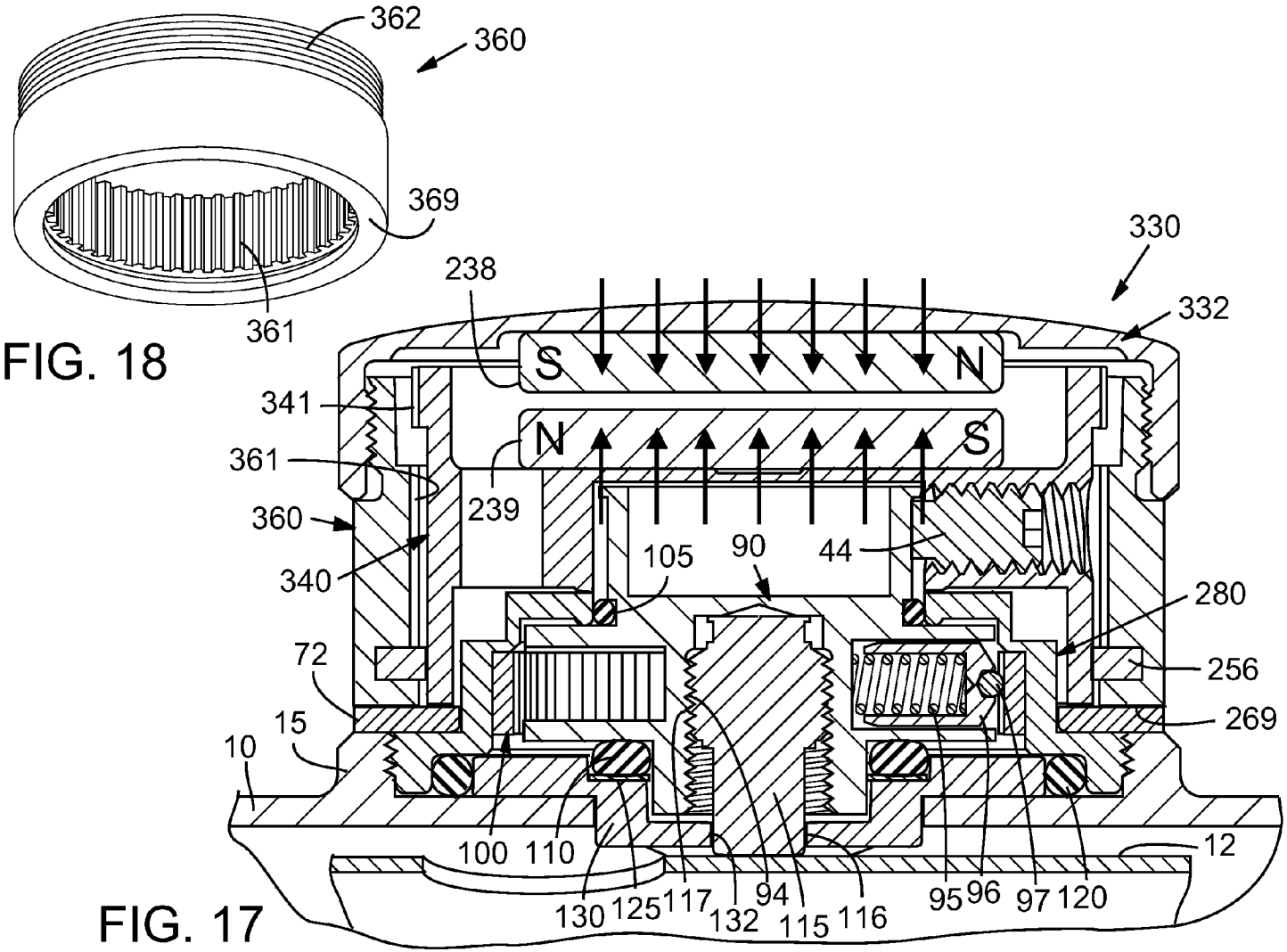
FIG. 17 is a cross-sectional view of the adjustment mechanism of FIG. 16 shown assembled in position on a riflescope, and with the cap in a closed position.
FIG. 18 is a detailed view of cap element for the embodiment of FIGS. 16-17.
Figure 19:
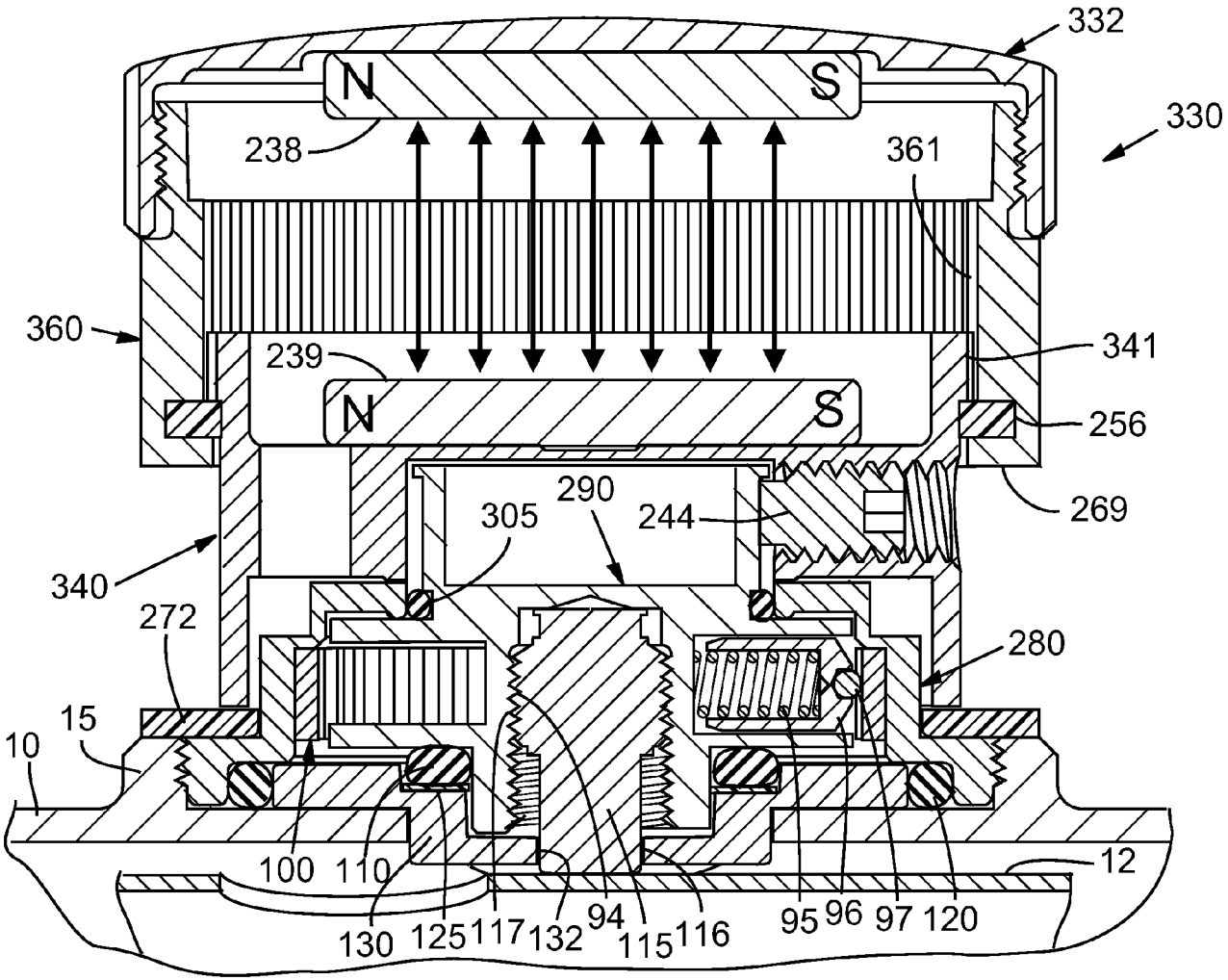
FIG. 19 is a cross-sectional view of the adjustment mechanism of FIGS. 16-17 with the cap in a released position and the adjustment screw in the retracted position.

Another preferred embodiment specifically illustrated in FIGS. 13-15 uses a unique magnetic configuration for providing the biasing/spring mechanism between the components. The components of this embodiment are similar to those of the first embodiment of FIGS. 1-12 and like numbered elements are identical to the first embodiment and the description of those elements will be omitted for brevity. In the alternate system 230, a first magnet 238 is attached to the underside top surface of the top cap 232. The cap key 260 has a somewhat different configuration from the cap key of 60 the prior embodiment. The top of the cap key 260 includes threads 262 that engage the inner threads 234 of the top cap 232. Preferably, the cap 232 is secured permanently to the cap key 260 such as via glue between the interlocking threads, but may comprise another suitable means for ensuring desired locking thread strength such as the o-ring 54 of the first embodiment. Thus the o-ring 54 shown in FIG. 13 is optional (depending upon the configuration) and is thus not shown in FIGS. 14-15.

The second magnet 239 is attached by glue (or other suitable attachment mechanism) in the upper cavity of the index ring 40. The magnets 238 and 239 are disk-shaped of diametrically opposed magnetic configuration. For an adjustment mechanism for a typical riflescope, the disk magnet is approximately the size of a United States nickel coin. The preferred size is approximately 0.750 inches (1.905 cm) in diameter with a thickness of 0.095 inches (0.24 cm). Powerful grade magnets are preferred, and a suitable magnet is made from Neodymium N50 grade magnetic material that is black nickel coated. The diametrically-opposed configuration is such that the north and south poles (designated "N" and "S") of each magnet are aligned along opposite lateral sides (of the diameter of the disk) as shown in the figures.

In FIG. 14, top cap section 232 is rotated to orient the magnets with the north pole of the lower magnet 239 adjacent to the south pole of the magnet 238, and vice versa on the opposite side, thus the magnets attract each other, keeping the top section of the mechanism in the closed position with the bottom surface 269 of the cap key 260 engaged against the gasket 72 in a sealing arrangement. As the top section is rotated approximately 90 degrees and then to 180 degrees as shown in FIG. 15, the north poles of the magnets become aligned with each other (as do the south poles), thus the magnets then provide a repelling force on each other forcing the upper section away from the lower section. Once in the extended position, the interconnection mechanism between the index ring 240 and the cap key 260 are engaged (the interconnection mechanism comprises the engagement of the flats 264*a,b* on the inner surface of the cap key 260 with the flats 48*a,b* on the index ring 240), whereby rotation of the top cap 232 serves to adjust the position of the adjustment screw 115.

In this diametric magnet configuration, the north and south poles are arranged such the north pole of the top magnet 238 is aligned to the south pole of the bottom magnet 239 when the flats 48*a*, 48*b* are aligned with flats 264*a*, 264*b*. Thus, if user grasping the top cap 232 applies enough upward force to the top cap 232 to overcome the magnetic attraction force, cap section will translate to the upward extended position without having to first rotate the cap 232, thus allowing for a quick rotary adjustment.

Using the desired powerful type of magnet, the attraction force is quite high and it is much easier to rotate the cap than axially translate. As the cap 232 is rotated (clockwise for example), the magnets not only exert an axial attraction force but also a rotational force. Assuming the at rest attraction state (with the north pole of magnet 239 aligned with the south poles of magnet 238 as in FIG. 14) as 0°, as the cap is rotated clockwise, a restoring counter-clockwise rotational force (back to 0°) is exerted by the magnets. This restoring rotational force gradually increases until the rotational position reaches about 90° and then decreases until the rotational position reaches about 180° where the rotational force dissipates to about zero. Past 180°, the rotational force reverses and urges the rotational position clockwise toward 360°. Further, as the rotational position passes 90°, the net axial attraction force reduces to zero and then past 90° the axial force reverses to a repelling force reaching a maximum at 180°. At 180°, the flats 48*a*, 48*b* are aligned with flats 264*a*, 264*b* thereby allowing the cap section to axially translate upward (the cap being urged upward by the repelling force of the magnets) into the engage state as shown in FIG. 15. With the flats 264*a*, 264*b* engaged, the index ring 240 is rotated via rotation of the cap 232 to allow adjustment of the adjustment screw 115 as in the first embodiment.

The previous embodiments employ flats between the index ring and the cap ring to provide an interlocking mechanism. Other suitable interlocking mechanisms may be employed such as splines or gears, bayonet connector, or even a manually activated mechanism such as those used for various child-proof caps. FIGS. 16-19 illustrate an embodiment employing one such alternate interlocking scheme. The components of this embodiment are similar to those of the prior embodiments of FIGS. 1-12 and/or 13-15 and like numbered elements are identical to the prior embodiment(s) and the description of those elements will be omitted for brevity. In the alternate system 330, a first magnet 238 is attached to the underside top surface of the top cap 232. The cap key 360 is a somewhat different configuration from the cap key of the prior embodiments. The top of the cap key 660 includes threads 362 that engage the inner threads 334 of the top cap 332. Preferably, the cap 332 is secured permanently to the cap key 360 such as via glue between the interlocking threads, but may comprise another suitable means for ensuring desired locking thread strength such as the o-ring 54 of the first embodiment of FIGS. 1-12. The cap key 360 includes radially inward extending splines or gears 361 at a lower portion thereof. These splines 361 engage corresponding splines 341 in the index ring 340. Thus since the splines may engage at any rotational position, the cap 332 need not be rotated at the 180° alignment position as in the embodiments employing the flats. Similar to the previous embodiment, the top cap section 332 is rotated to orient the magnets with the north pole of the lower magnet 239 adjacent to the south pole of the upper magnet 238, and vice versa on the opposite side, thus the magnets attract each other, keeping the top section of the mechanism in the closed position with the bottom surface 369 of the cap key 360 engaged against the gasket 72 in a sealing arrangement.

Though the spline/gear engagement mechanism of FIGS. 16-19 is illustrated with a magnet configuration, such an engagement mechanism may be particularly suited for the spring configuration of FIGS. 1-12.

Various other spring and magnet combinations are envisioned. For example, a magnet configuration similar to the configuration of FIGS. 13-15 or FIGS. 16-19 except that the disk magnets 238, 239 are of conventional configuration with north and south poles on the top and bottom surfaces. If the two magnets are arranged with opposite poles facing each other, the magnets will attract each other no matter the radial orientation. To separate the magnets, the user applies sufficient force on the cap 232 to overcome the magnetic attraction force of the magnets and translate the upper section away from the lower section and thus allow engagement of the interlocking mechanism (such as the flats 48*a*/48*b* and 264*a*/264*b* of FIGS. 13-15 or the splines 341 and 361 of FIGS. 16-19). Upon release of the cap, the magnet attraction force returns the cap 232 to the closed position.

A spring mechanism may be employed in place of the magnets of the previous embodiment whereby the spring is placed in tension (rather than in compression) connected at one end to the top cap and at the bottom to the index ring. In tension, the spring urges the upper cap section downward into the closed position at all times. A suitable mechanism may be provided to allow the spring to avoid rotating when the cap is rotated. Alternately, rotation of the cap may adjust the spring tension. Other spring embodiments may include spring force adjustment by axial or rotational tensioning of the spring.

In yet another alternate embodiment, the springs and magnets may be entirely omitted. For example, in the embodiment of FIGS. 1-12, if the spring 38 was omitted there would be no biasing as between the cap combination 32/60 and the index ring 40, but the user would merely manually between the contracted closed position (FIG. 2) to the extended position (FIG. 3). The device may be provided with a suitable mechanism to somewhat retain the cap combination 32/60 in the extended position such as designing the flats 48*a*, 48*b* with some friction fit within the flats 64*a*, 64*b*.

Thus according to certain of the above-described embodiments, in the field, when windage or elevation changes (for example) are called for, the adjustment system allows the user to make windage or elevation adjustments to the sighting device without using tools or removing the scope cap(s). Rotating the captive pop-up one-half turn from its locked position enables the user to lift the cap and turn the adjustment knob for making the desired adjustments.

Thus preferred lens systems and ocular configurations have been shown and described. While specific embodiments and applications for an ocular have been shown and described, it will be apparent to one skilled in the art that other modifications, alternatives and variations are possible without departing from the inventive concepts set forth herein. Therefore, the invention is intended to embrace all such modifications, alternatives and variations.

The invention claimed is:

1. An apparatus for engaging an adjustment mechanism for a sighting device, comprising a cap having (1) an outer annular surface that is grippable by a user and (2) a rotational axis, wherein the cap is operative for axially translating along the axis between (a) a first closed axial position where rotation of the cap does not engage the adjustment mechanism and (b) a second extended axial position where rotation of the cap actuates the adjustment mechanism for making a position adjustment to an internal component of the sighting device, wherein in the first axial position, the cap is rotatable from (i) a first rotational position at which the cap is restrained from axial translation to (ii) a second rotational position at which the cap is released for axial translation from the first closed axial position to the second extended axial position, wherein the cap is constructed and arranged to remain connected to the sighting device in both the first closed position and the second extended position.

2. An apparatus according to claim 1 further comprising means for biasing or urging the cap between the closed position and the extended position.

3. An apparatus according to claim 2 wherein the means for biasing or urging comprises a spring.

4. An apparatus according to claim 3 wherein the spring comprises a wave spring.

5. An apparatus according to claim 2 wherein the means for biasing or urging comprises a magnet.

6. An apparatus according to claim 2 wherein the means for biasing or urging comprises first and second disk-shaped magnets disposed between the cap and the adjustment mechanism, the first magnet being attached to the cap and the second magnet being attached to the adjustment mechanism.

7. An apparatus according to claim 6 wherein the first and second magnets each has a diametrically-opposed magnetic configuration, wherein depending upon the rotational alignment of the magnets relative to one another, the magnets either repel or attract each other.

8. An apparatus according to claim 6 wherein the first and second magnets are comprised of Neodymium magnetic material.

9. An apparatus according to claim 7 wherein the first and second magnets each have diametrically opposed north and south poles, wherein at a first relative rotational alignment, the south pole of the first magnet aligns with the north pole of the second magnet thereby attracting first and second magnets together and wherein at a second relative rotational alignment, the south pole of the first magnet aligns with the south pole of the second magnet thereby repelling the first and second magnets apart.

10. An apparatus according to claim 1 further comprising a sighting device selected from a riflescope, binocular or spotting scope, the sighting device including the cap and the adjustment mechanism, wherein the cap is operative to engage the adjustment mechanism when the cap is in the second extended position.

11. An apparatus according to claim 1 further comprising an interconnection between the cap and the adjustment mechanism, the interconnection comprising flats on an inner surface of the cap that selectively engage flats on an outer surface of the adjustment mechanism depending upon axial position of the cap.

12. An apparatus according to claim 11 wherein the adjustment mechanism includes an adjustment screw that translates axially in response to rotation of the cap when the cap is in the second extended axial position.

13. An apparatus for engaging an adjustment mechanism for a sighting device, comprising a cap having (1) an outer annular surface that is grippable by a user and (2) a rotational axis, wherein the cap is operative for axially translating along the axis between (a) a first closed axial position where rotation of the cap does not engage the adjustment mechanism and (b) a second extended axial position where rotation of the cap actuates the adjustment mechanism for making a position adjustment to an internal component of the sighting device, wherein in the first axial position, the cap is rotatable from (i) a first rotational position at which the cap is restrained from axial translation to (ii) a second rotational position at which the cap is released for axial translation from the first closed axial position to the second extended axial position, wherein the cap is constructed and arranged to remain connected to the sighting device in both the first closed position and the second extended position;

a spring mechanism operative, once the cap is in the second rotational position, to bias the cap from the first closed position to the second extended position.

* * * * *